United States Patent [19]

Brown

[11] 4,306,632

[45] Dec. 22, 1981

[54] LADDER SUPPORT

[76] Inventor: Owen Brown, 7217 Bridges La., Cincinnati, Ohio 45230

[21] Appl. No.: 127,904

[22] Filed: Mar. 6, 1980

[51] Int. Cl.[3] ..... E06C 7/48

[52] U.S. Cl. ..... 182/214; 182/107; 182/229; 182/45; 248/210

[58] Field of Search ..... 182/214, 107, 108, 45, 182/230, 181, 224; 248/210, 238

[56] References Cited

U.S. PATENT DOCUMENTS

| | | | |
|---|---|---|---|
| 1,659,113 | 2/1928 | Marks | 182/182 |
| 2,329,415 | 9/1943 | Osborne | 182/45 |
| 3,237,717 | 3/1966 | Jackson | 182/45 |
| 3,435,912 | 4/1969 | Scherer | 182/107 |
| 4,131,108 | 12/1978 | Bauder | 182/181 |

*Primary Examiner*—Reinaldo P. Machado

*Attorney, Agent, or Firm*—Kinney and Schenk

[57] ABSTRACT

A ladder support having a pyramidal configuration with a ladder rest at the apex of the pyramid which provides a stable rest for supporting a ladder proximal to eaves of a building structure.

7 Claims, 4 Drawing Figures

LADDER SUPPORT

BACKGROUND

When working on building structures, it is frequently difficult for the worker to properly position himself for work on particular troublesome areas of the building structure. One of these troublesome areas is near the top of the structure adjacent eaves which project outwardly beyond the side of the building structure. Workman often use ladders to gain access to those portions of the building near the eaves.

It is common practice to use gutters on these eaves. Unfortunately, the structural quality of these gutters is often insufficient to support the weight of a ladder and of the workman. In many situations, the only feasible way of obtaining access to certain areas of the building is to rest the ladder on the gutter. As a result, the gutter is often damaged by the ladder. Further, the instability of the gutters places the worker in a precarious position when his ladder is supported on the gutter. The problems caused by gutters on the eaves of building structures has accentuated in recent years with the widespread use of aluminum gutters.

Moreover, it is also necessary to repair and replace gutters on occassion. This type of gutter repair is extremely awkward when the ladder is rested against the gutter, even when the gutter has sufficient strength to support the ladder. It is thus often necessary to rest the ladder on the side of the building beneath the eave. The distance which the eave extends from the side of the building frequently makes work from this ladder location impractical and time consuming.

In the past, attempts have been made to provide ladder supports which permit the ladder to rest at a location which positions the worker conveniently. For the most part, however, these attempts have not been successful. The prior art ladder supports have generally lacked the requisite stability for secure support of the ladder, or they have been unduly awkward and cumbersome. While some of the more cumbersome supports do support the ladder satisfactorily, their operation has been so time consuming that they have been self defeating from an economic standpoint.

It is accordingly a primary object of the present invention to provide a ladder support which has a minimal set up time and is easy to use.

It is a further object of the present invention to provide a ladder support which has a high degree of stability.

It is yet another object of the present invention to provide a ladder support which will support a ladder adjacent an eave of a building structure without damaging the structure.

It is a further object of the present invention to provide a ladder support which has no moving parts.

SUMMARY OF THE INVENTION

In accordance with the invention, a ladder support is provided which includes a base having a pyramidal configuration. The base includes a plurality of legs converging upwardly to a common junction at the apex of the pyramidal structure. A ladder rest for supporting a ladder is rigidly connected to the legs at this common junction and extends in a direction which is transverse to that of the legs. Ladder stops are provided on opposite ends of the ladder rest for preventing sliding movement of a ladder which is supported upon the ladder rest.

In accordance with a further aspect of the invention, the base of the support includes two pairs of legs. The first set of legs extending for a first predetermined length and the second pair of legs extending for a second predetermined length.

BRIEF DESCRIPTION OF THE DRAWINGS

Other objects and advantages of the invention will become apparent upon reading the following detailed description and upon reference to the drawings, in which.

DETAILED DESCRIPTION OF THE PREFERRED EMBODIMENT

Figure 1:
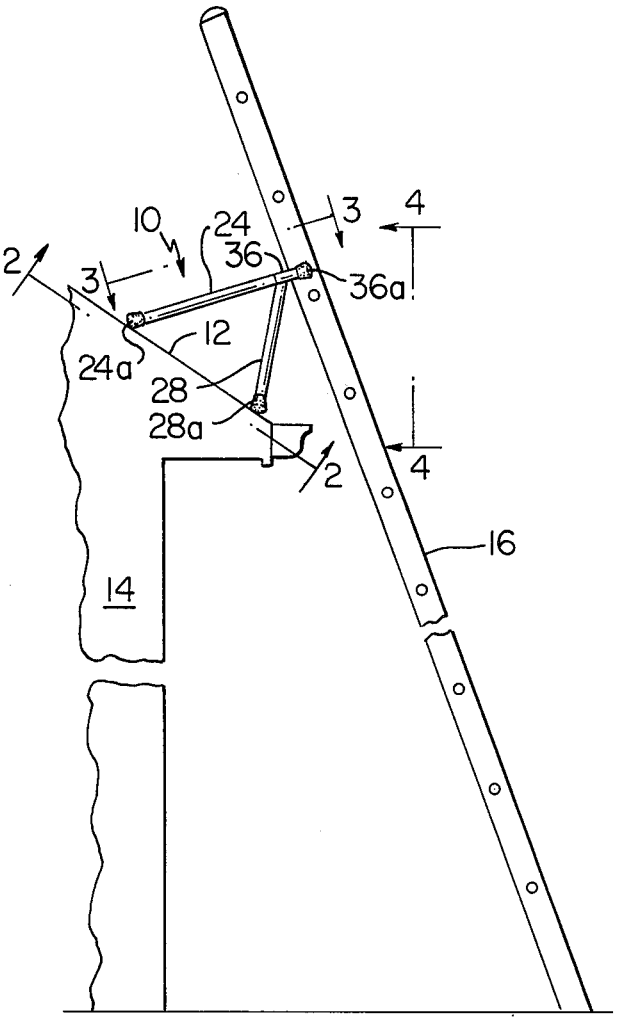
FIG. 1 is a fragmentary side elevational view of a ladder support according to the present invention supporting a ladder adjacent to the eave of a building structure.

Referring now to the drawings and to FIG. 1 in particular, a ladder support 10 resting on a roof 12 of a building structure 14 is shown. The ladder support 10 is supporting a ladder 16 in a position which is proximal to, but spaced from, a gutter 18 which is attached to an eave 20 of a building structure 14.

Figure 2:
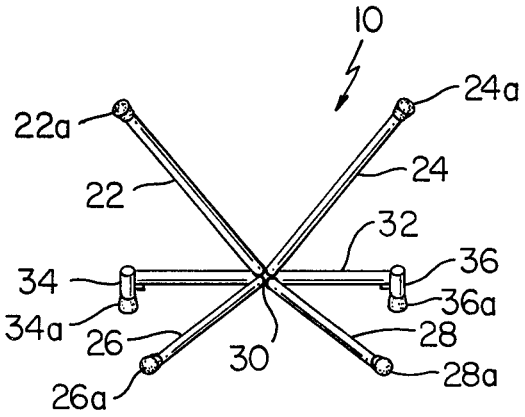
FIG. 2 is a bottom view of the ladder support of FIG. 1 taken in the direction of line 2—2 in FIG. 1.

As perhaps seen best in FIG. 2, the ladder support 10 includes a plurality of legs 22, 24, 26, and 28 having a common junction at location 30. Each of the legs 22, 24, 26, and 28 have end caps **22*a*, 24*a*, 26*a*, and 28*a* on their free ends. The junction 30 also joins the legs 22, 24, 26, and 28 at their ends to a cross bar or ladder support 32 which extends in a direction transverse to that of the legs. Ladder stops 34 and 36 extend perpendicularly from cross bar or ladder support 32 on each end of the ladder support 32. The ladder stops 34 and 36 are approximately two inches in length and have end caps 34*a* and 36*a* on their free ends. Each of the end stops 35 and 36 has an adjacent spacer element which extends upwardly from the cross bar 34 approximately one half inch and inwardly from the respective end stops 34 and 36 approximately one half inch. Spacer 40 is adjacent to end stop 34 and spacer 42 is adjacent to end stop 36**.

Figure 3:
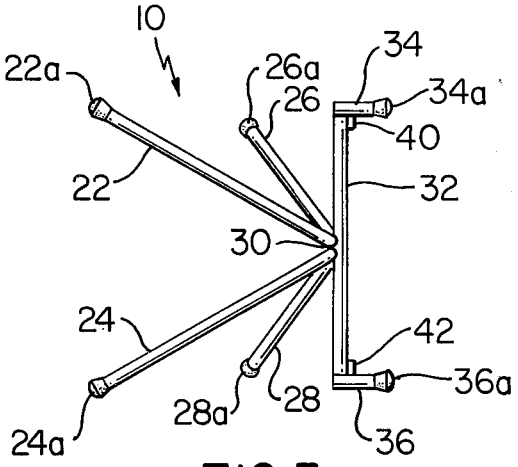
FIG. 3 is a perspective view of the ladder support of FIG. 1 taken in the direction of line 3—3 in FIG. 1.
Figure 4:
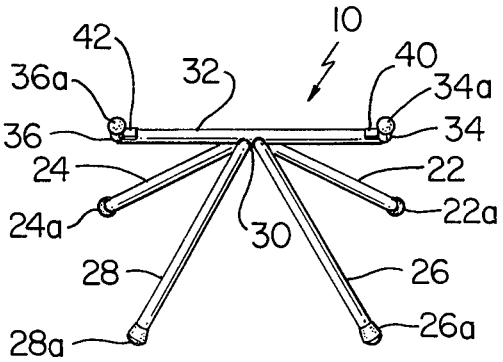
FIG. 4 is a perspective view of the ladder support of FIG. 1 taken in the direction of line 4—4 in FIG. 1.

Referring now to FIGS. 3 and 4, it will be noted that the legs 22, 24, 26 and 28 form a pyramidal configuration and converge toward an apex at junction 30, where they are rigidly connected to ladder support 32. Also, the length which ladder support 32 extends is slightly less than the corresponding extension of the free ends of the legs 22, 24, 26 and 28 in the same direction. The transverse extension of the ladder support 32 does, however, approximate that of the transverse extension of legs 22, 24, 26 and 28 in the same direction. These relative dimensions optimize the compactness of the ladder support with the size of the ladder which may be fitted on the ladder support 32 while maintaining stability.

Referring back to FIG. 1, it will be seen that the legs forming the base are dissimilar in length, leg 24 being longer than leg 28. From a combined viewing of FIGS. 2–4, it will be seen that the base is in the form of two sets of legs. A first set of legs is formed by legs 22 and 24 which have a common length while a second set is formed by legs 26 and 28 which also have a common length which is less than the length of the first set formed by legs 22 and 24.

FIG. 1 also shows that the end stops 36 and 38 extend substantially perpendicularly from the crossbar 32 in a direction which is in the plane formed by the first set of legs 24 and 22. It is thus seen that legs 24 and 22 form a set of rear legs while legs 28 and 26 form a pair of front legs. As a result of the dissimilar lengths of the two sets of legs, the ladder support 10 resists sliding upon an angled roof such as that shown by roof 12 as a result of force transmitted to the support 10 by the ladder 16.

The spacers 40 and 42 are optional. They are most helpful when the worker requires heavy materials at his work location. For example, when shingling a roof, it is necessary to transport large bundles of heavy shingles onto the roof. The spacers 40 and 42 prevent the ladder 16 from sliding laterally upon ladder support 32 to the end stops 34 or 36. It is then possible to apply a pulley to ladder support 32 and to use this pulley to transport heavy materials to the work location.

Thus it is apparent that there has been provided, in accordance with the invention, a ladder support that fully satisfies the objects, aims and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and scope of the appending claims.

What is claimed is:

1. A ladder support structure, comprising:

(a) a base having a pyramidal configuration, said base including two pairs of legs converging upwardly to a common junction at an apex of the pyramidal configuration;

(b) a ladder rest for supporting a ladder extending transverse to said legs and being rigidly fixed to said base at the apex of the pyramidal configuration, said rest extending for a predetermined distance on opposite side of said apex, the transverse extension of said rest having a length which is less than but which approximately equals the corresponding dimension of the base distal to said apex; and (c) ladder stops affixed to opposite ends of the ladder rest and extending substantially perpendicular thereto for preventing sliding movement of a ladder on the ladder rest.

2. A ladder support structure as recited in claim 1 wherein said base includes a first pair of legs of a first predetermined length and a second pair of legs of a second predetermined length.

3. A ladder support structure as recited in claim 2 wherein the length of said first pair of legs is dissimilar from the length of said second pair of legs.

4. A ladder support structure as recited in claim 3 wherein said first pair of legs has a length which is longer than that of said second pair of legs.

5. A ladder support as recited in claim 3 wherein said first pair of legs define a geometric plane, said ladder stops extending away from said ladder rest in said first plane.

6. A ladder support as recited in claim 1 further including spacers adjacent the ladder stops for inhibiting slippage of a ladder into the ladder stops to establish a spacing between the ladder and the ladder stops.

7. A ladder support as recited in claim 6 wherein the stop spacers extend upwardly from the ladder rest for approximately one half inch and the ladder stops extend upwardly from the ladder rest for at least two inches.

* * * * *